US005493981A

United States Patent [19]

del Castillo

[11] Patent Number: 5,493,981

[45] Date of Patent: Feb. 27, 1996

[54] SEMI-AUTOMATIC TOP STITCHER WITH DIE PLATE AND MOVABLE SUPPORT

[75] Inventor: Fernando del Castillo, Brownsville, Tex.

[73] Assignee: Ideal Equipment Company, Ltd., Montreal, Canada

[21] Appl. No.: 313,366

[22] Filed: Sep. 27, 1994

[51] Int. Cl.[6] ..... D05B 21/00

[52] U.S. Cl. ..... 112/470.14; 112/470.33; 223/2

[58] Field of Search ..... 112/120, 147, 112/141, 306, 311, 470.13, 470.14, 470.18, 470.09, 475.09; 223/37, 38, 81, 84, 2, 4; 83/901; 156/93

[56] References Cited

U.S. PATENT DOCUMENTS

| | | | |
|---|---|---|---|
| 3,174,447 | 3/1965 | Bono | 223/2 X |
| 4,073,247 | 2/1978 | Cunningham et al. | 112/121.12 |
| 4,175,681 | 11/1979 | Scholl et al. | 83/901 X |
| 4,643,115 | 2/1987 | Junemann | 112/121.22 |
| 4,821,659 | 4/1989 | Morii et al. | 112/121.15 |
| 4,898,109 | 2/1990 | Scholl | 112/470.13 |
| 5,280,759 | 1/1994 | Scholl | 112/470.14 X |
| 5,421,278 | 6/1995 | del Castillo | 112/470.18 |

FOREIGN PATENT DOCUMENTS

| | | | |
|---|---|---|---|
| 3192485 | 8/1988 | Japan | 112/121.15 |

*Primary Examiner*—C. D. Crowder
*Assistant Examiner*—Ismael Izaguirre
*Attorney, Agent, or Firm*—G. Turner Moller

[57] ABSTRACT

A semiautomated sewing station prepares a fabric workpiece for a top stitching operation and then does the top stitching. A work holder comprises a die plate receiving the workpiece. A support is raised from under the die plate to hold the workpiece against the die plate after it is manipulated by the worker. An edge former pushes the seamed edge of the workpiece under the die plate and a press pushes the top of the workpiece against the die plate. The edge former and press are heated. A transfer plate moves over the workpiece, pushes it against a smooth work table and the die plate, edge former and presser are retracted out of the way. The transfer plate moves the workpiece to a sewing needle where the top stitches are sewn.

20 Claims, 3 Drawing Sheets

FIG. 4
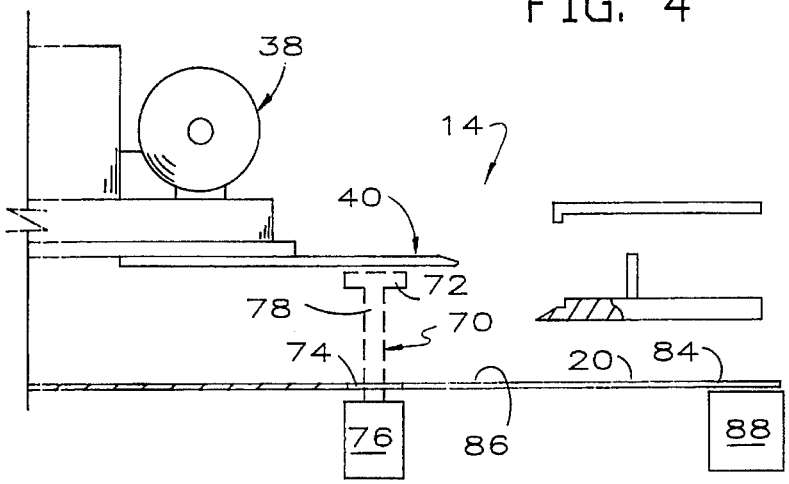
FIG. 5
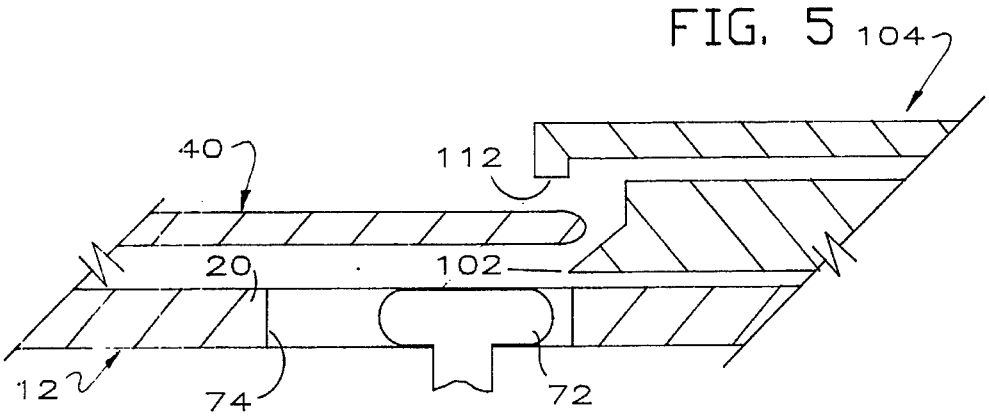
FIG. 6
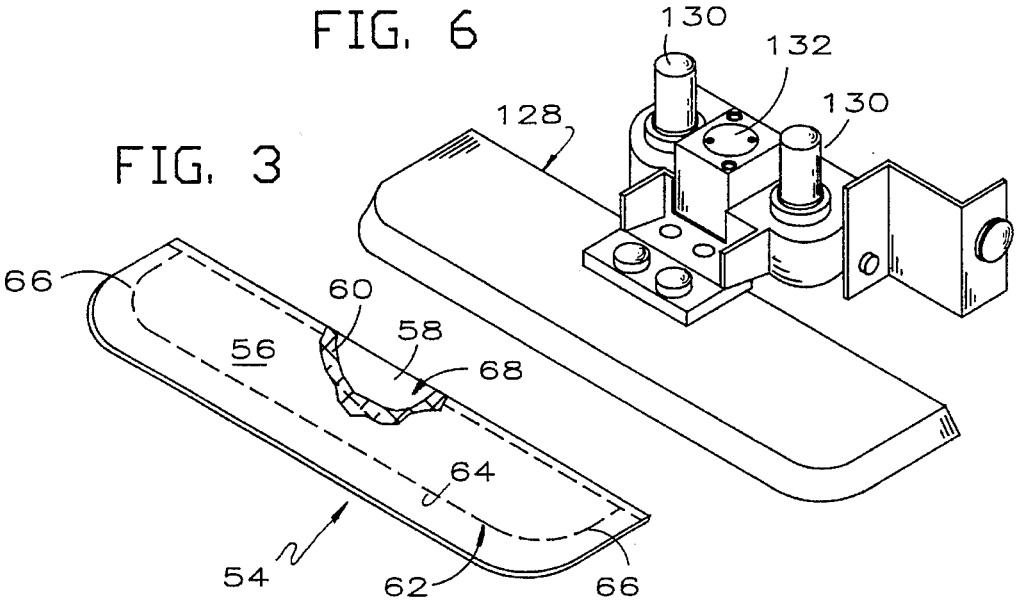
FIG. 3

SEMI-AUTOMATIC TOP STITCHER WITH DIE PLATE AND MOVABLE SUPPORT

This invention relates to a work station where sewing operations are conducted on a textile workpiece.

BACKGROUND OF THE INVENTION

The manufacture of apparel has changed from a wholly hand manipulated, machine sewing operation to a series of work stations where parts of the garment are made in a more-or-less semiautomated manner. These parts are then assembled in a hand manipulated, machine sewing operation. This change has reduced the labor content of apparel, such as shirts, so that much of the manufacturing operation has returned to the better developed countries from underdeveloped countries where labor costs are quite low.

Three of the processes which have been semiautomated are the manufacture of shirt cuffs, pocket flaps and shirt collars from cut blanks of material into a subassembly which is ready to be sewn onto panels of fabric which will ultimately become a shirt. There are three distinct operations: (1) a running operation in which fabric blanks are sewn together along a path near three sides, (2) an inverting and pressing operation in which the workpiece is turned inside out and ironed and (3) a top stitching operation in which a second series of stitches are sewn near the same three sides of the blanks.

Cuff, collar and pocket flap running and top stitching machines have become quite similar because the operations are quite similar. Exemplary state of the art cuff and collar machines offered by applicant's assignee are found in U.S. Pat. No. 4,841,887 and U.S. patent application Ser. No. 08/131,603, filed Oct. 5, 1993 and entitled SEMI-AUTOMATIC SEWING STATION, now U.S. Pat. No. 5,421,278, the disclosures of which are incorporated herein by reference. These machines comprise a smooth horizontal table, a work holder where a textile workpiece is positioned by a worker and manipulated by the holder, a sewing machine, a transfer arm that moves to the work holder, pushes the workpiece against the table, slides the workpiece to the sewing machine and then moves the workpiece around under the sewing needle as stitching occurs and a digital controller for energizing all of the components of the device at the correct times. It is this type device that this invention most nearly relates.

One common semi-automated operation is called running. A fabric workpiece is first prepared by juxtaposing a front, a back and a backing. A generally U-shaped seam is sewn in a running operation to leave a central pocket and one unstitched edge. The shape of the workpiece, the seam and the pocket depend on whether the workpiece is going to be a cuff, a pocket flap or a collar and on the particular design desired in the end product. The fabric workpiece is trimmed, turned inside-out and pressed in one operation and top stitched in a second separate operation. The workpiece is trimmed at the corner because, when it is inverted, there is normally too much material in the corner causing the finished workpiece to appeared puckered. Special purpose machines are used to trim, invert and press cuff, pocket flap and collar workpieces such as Model DS515D from Bou-Yue Manufacturing Co., Ltd. of Taiwan.

Top stitching is very similar to running because the stitching is along generally the same path. In a top stitching operation, the textile workpiece is taken from the inverter/presser, placed in a guide and smoothed down by the worker and the transfer arm moves the workpiece from the guide to the sewing station.

SUMMARY OF THE INVENTION

In this invention, the separate operation at the inverter/presser is omitted, at least for cuffs and pocket flaps. The operator inverts the workpiece and slips it onto a die plate located above the stainless steel table so the die plate extends into the pocket of the workpiece. The die plate is expanded to stretch the material. The worker manipulates the workpiece to place the seam along or slightly under the edge of the die plate. This seam is the central section of the stitching and, in a cuff, corresponds to the leading edge of the material that encircles the wrist. On command, a support is moved upwardly into engagement with the bottom of the die plate to hold the workpiece in position. The die plate and support are moved downwardly into engagement with the table.

An edge former is advanced into engagement with the seamed edge of the workpiece and thus juxtaposes the edge of the die plate. This pushes the leading edge of the workpiece slightly under the leading edge of the die plate. A presser on the edge former moves downwardly into engagement with the workpiece. The edge former and/or presser are more-or-less continuously heated with an electric heater so the leading edge of the workpiece is held in its desired position, heated and pressed.

The transfer arm moves over the workpiece and pushes the workpiece downwardly against the table top. The presser is raised. The die plate and edge former/presser are retracted away from the workpiece. The transfer arm slides the workpiece to the sewing needle and moves the workpiece in a desired path so the desired pattern is stitched onto the workpiece. While sewing is occurring, the worker is putting the next workpiece on the die plate and the process is repeated.

This technique has substantial advantages because it eliminates a special purpose machine to prepare fabric workpieces for top stitching and eliminates the effort running the special purpose machine. Those skilled in the art realize the labor content of shirts has fallen to a range of $1.50–9.00/shirt and that further cost reductions are difficult. Thus, the elimination of a conventional work station and its cost of operation with no reduction in throughput of subsequent operations is highly significant.

It is accordingly an object of this invention to provide an improved machine for top stitching fabric workpieces.

Another object of this invention is to provide an improved technique which eliminates a series of steps leading up to a top stitching operation.

A further object of this invention is to provide an improved machine which incorporates many of the steps of preparing a workpiece for a top stitching operation into the top stitching operation.

Other objects and advantages of this invention will become more fully apparent as this description proceeds, reference being made to the accompanying drawings and appended claims.

BRIEF DESCRIPTION OF THE DRAWINGS

FIG. 3 is an isometric view of a workpiece of this invention;

FIG. 4 is a side view of the work holder of this invention;

FIG. 5 is an enlarged cross-sectional view of the work holder of this invention illustrating the various components at a time when the presser engages the workpiece; and FIG. 6 is a partial isometric view of a transfer arm used to slide the workpiece from the work holder to the sewing needle.

DETAILED DESCRIPTION

Figure 1:
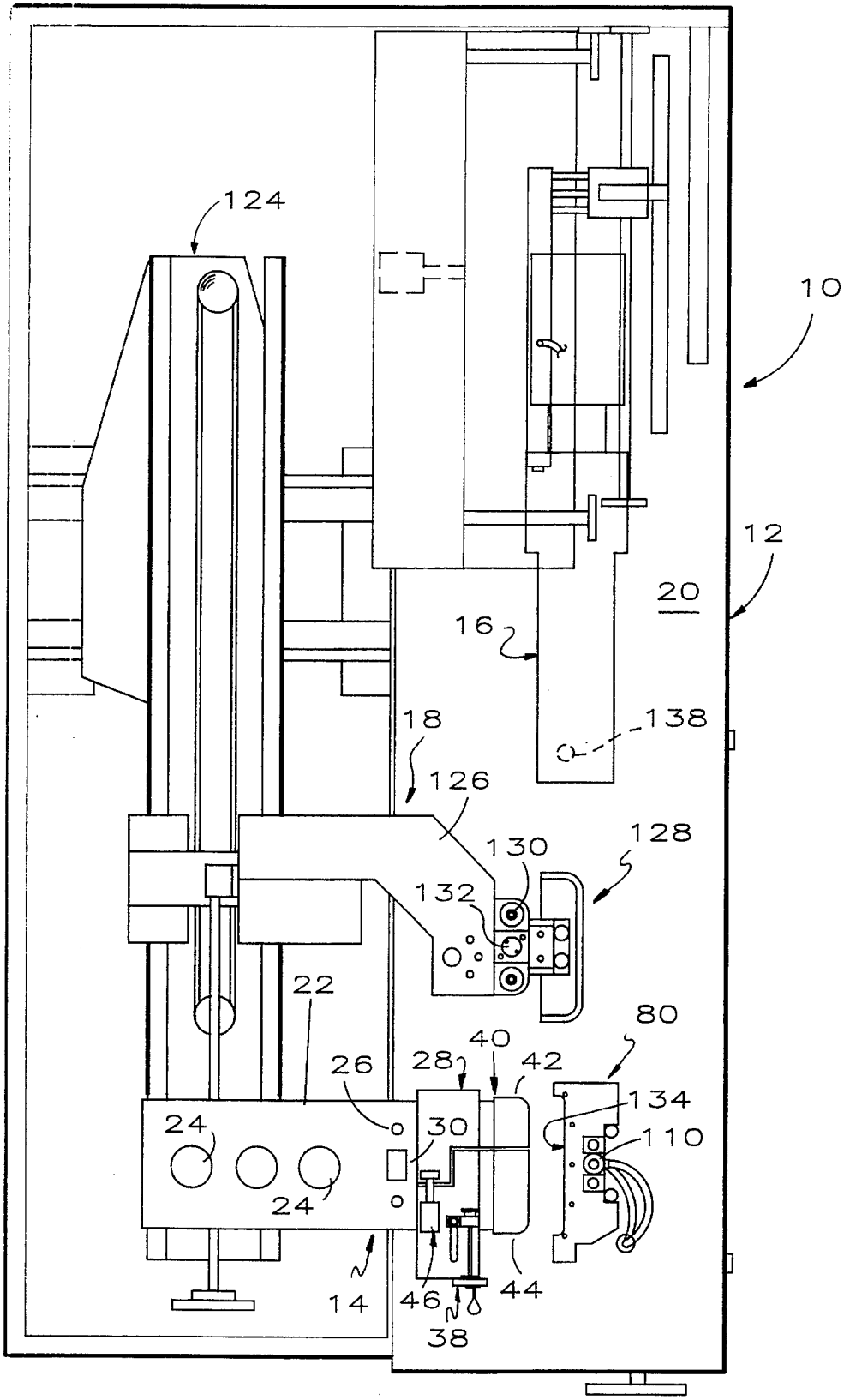
FIG. 1 is a top plan view of a machine of this invention configured to conduct a top stitching operation on cuffs.
Figure 2:
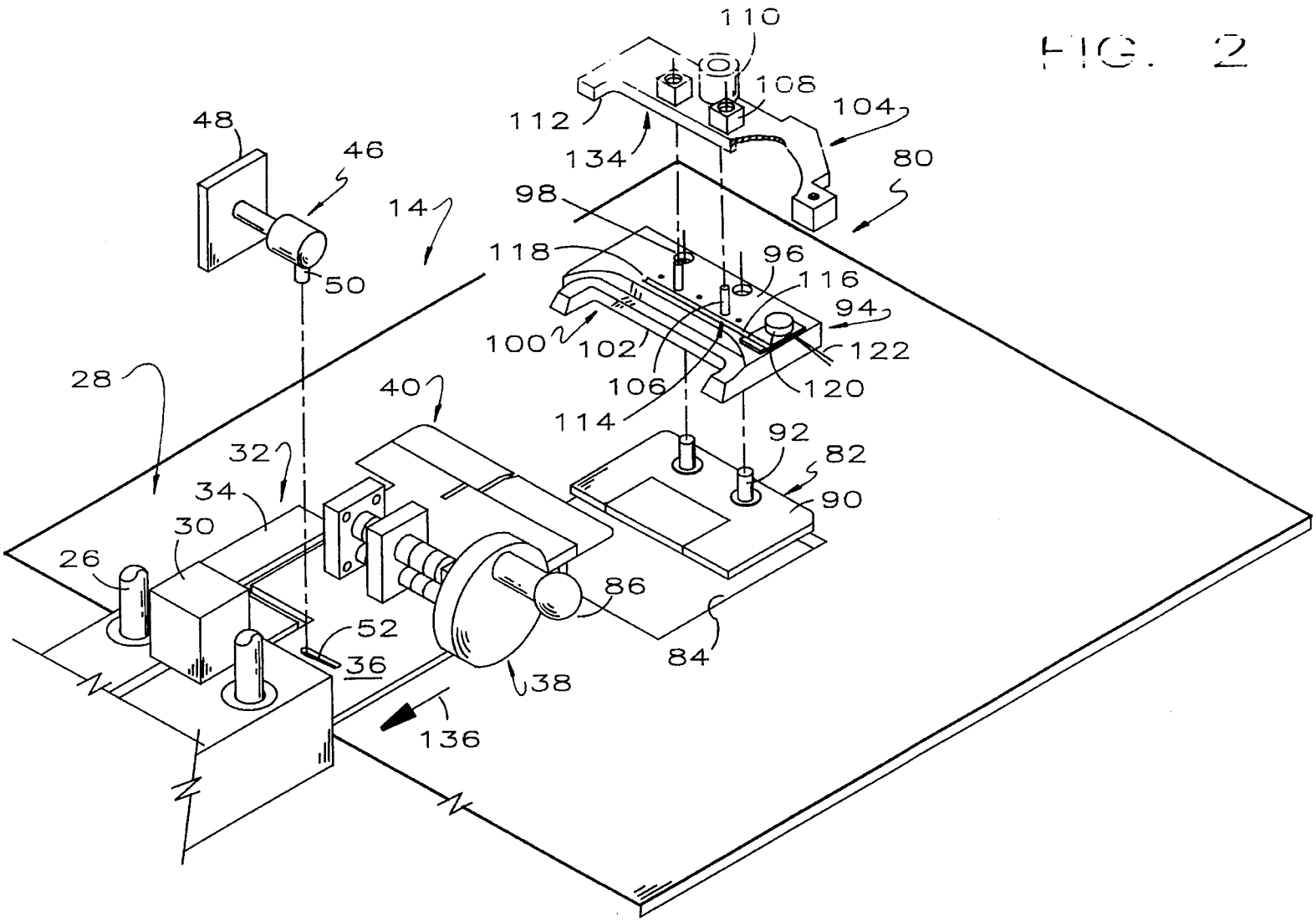
FIG. 2 is an exploded isometric view of the work holder of this invention.

Referring to FIGS. 1–4, a top stitch machine 10 of this invention comprises, as major components, a work table 12, a holder 14 for receiving and manipulating fabric workpieces, a sewing head 16, means 18 for sliding the fabric blanks from the holder 14 toward the sewing head 16 and a digital controller (not shown) for energizing the various components of the machine 10 at the appropriate times. The work table 12 includes a smooth planar table section 20 which is stainless steel or the like so it remains smooth for a substantial period.

The holder 14 comprises a cast support 22 mounted on pins 24 and providing a pair of pins 26 mounting a die plate assembly 28 for vertical movement relative to the table 12. An air cylinder 30 moves the die plate assembly 28 vertically on command from a lower position adjacent the table top 20 to an elevated position. The die plate assembly 28 includes a base 32 comprising a stationary section 34 and a movable section 36 mounted for movement by a gross adjusting device 38 to adjust the spacing between the sections 34, 36 and thereby alter the size of the workpiece received on the die plate 40. The adjusting device 38 may be of any suitable type.

The die plate 40 comprises a section 42 rigid with the section 34 and a movable section 44 guided on and movable relative to the movable section 36. An air cylinder 46 includes an abutment 48 affixed to the stationary die plate section 34 and a lug 50 extending through a slot 52 into engagement with the movable die plate section 44.

Referring to FIG. 3, a fabric workpiece 54 comprises a front panel 56, a back panel 58 and one or more backing panels 60 that have been stitched together in a running operation to provide a generally U-shaped seam 62 providing a central seam section 64 and a pair of end seam sections 66. The workpiece 54 accordingly provides a central pocket 68. Those skilled in the art will recognize the workpiece 54 will be incorporated into a shirt as a cuff. Similar workpieces that will become pocket flaps and collars may also be used in this invention.

It will be seen that the adjusting device 38 allows the die plate 40 to be adjusted so accommodate workpieces 54 of different size. It is thus quite convenient to change the holder 14 from making one size shirt to a larger size shirt.

With the air cylinder 46 retracted, the operator places the central pocket 68 of the workpiece 54 onto the die plate 40. The air cylinder 46 is then extended thereby tightening the workpiece on the die plate 40. The operator adjusts the fabric of the workpiece 54 on the die plate 40 so the central seam section 64 lies slightly under the leading edge of the die plate 40. The exact shape of the die plate sections 42, 44 are changed depending on the shape of the workpiece. The die plate sections 42, 44 are thus removable and can be replaced as desired.

Referring to FIGS. 4 and 5, a support 70 is mounted under the die plate 40 for movement between a retracted position generally planar with the table top 20 to an extended position abutting the die plate 40 for holding the fabric workpiece 54 in place after the operator has adjusted the workpiece 54 to position the seam 64 in an appropriate manner. The support 70 comprises a long narrow plate 72 received, in the retracted position, in a slot 74 in the table top 20. An air cylinder 76 comprises one or more rods 78 of sufficient length to elevate the plate 72 to abut the die plate 40 in its elevated position. After the workpiece 54 is positioned on the die plate 40 and adjusted, the operator raises the support 70 to hold the workpiece 54 in position. Then, the die plate assembly 28 and the support 70 are simultaneously lowered to captivate the lower half of the workpiece 54 against the table top 20. In addition, the support 70 may be mounted for movement horizontally away from the leading edge of the die plate 40 for snugly pulling the central seam 64 of the workpiece 54 under the leading edge of the die plate 40.

The work holder 14 also includes a clamp 80 comprising a base 82 mounted in a slot 84 for horizontal movement toward and away from a work area 86 under the die plate 40. An air cylinder 88 is accordingly provided to move the base 82 from an extended position adjacent the work area 86 to a retracted position away from the work area. The base 82 includes a bottom plate 90 from which extend a pair of pins 92.

The clamp 80 includes an edge former 94 comprising a plate 96 having openings 98 receiving the pins 92 therein. The plate 96 provides a recess 100 shaped to closely receive the leading edge of the workpiece 54. The recess 100 provides a chamfered edge 102 which pushes the fabric workpiece 54, adjacent the seam section 64, under the die plate 40 as the base 82 is moved from its retracted position toward the extended position adjacent the work area 86.

The edge former 94 also acts as a base for a presser 104 and accordingly includes a pair of upstanding pins 106. The presser 104 includes a pair of spaced bosses providing openings 108 receiving the pins 106 and mounting the presser 104 for vertical movement in response to actuation of an air cylinder 110. The presser 104 includes a rib 112 shaped to match the edge of the workpiece 54. As shown best in FIG. 5, the presser 104 extends beyond the end of the edge former 96 so the rib 112 is positioned to engage the workpiece 54 and push it against the die plate 40.

An important feature of the clamp 80 comprises means 114 for heating the edge former 94 and the presser 104. The heating means 114 includes an electrical heating element 116 mounted in a groove 118 in the edge former 94 generally parallel to the long edge of the recess 100. The heating means 114 also includes a thermostat 120 and wiring 122 for energizing the heating element 116.

After the workpiece 54 has been placed on and adjusted relative to the die plate 40, the support 70 is raised to hold the workpiece 54 in position. In this regard, it will be appreciated that the plate 72 does not extend to the edges of the die plate 40 so there is sufficient room for the fingers of the operator. The die plate assembly 28 and the support 70 are simultaneously lowered to their lower position. The clamp 80 is then advanced on command by the cylinder 88 so the edge 102 further pushes the seam 64 under the leading edge of the die plate 40. Because the recess 100 closely receives the die plate 40, it will be seen that the entire forward edge of the workpiece 54 is tucked under the die plate 40. The presser 104 is then lowered by the cylinder 110 into engagement with the edge of the workpiece 54 thereby pushing the workpiece 54 against the die plate 40. This smoothes the workpiece 54 and, in cooperation with the heat applied by the heating means 114, irons or presses the workpiece so it will stay in position during sewing.

As shown best in FIGS. 1 and 6, the transfer means 18 includes an x-y positioner 124 having a transfer arm 126 receiving a transfer clamp 128 configured in the shape of the workpiece 54. The transfer arm 126 includes a pair of upstanding pins 130 receiving the transfer clamp 128 for vertical movement between a position elevated above the table top 20 and a position pushing the workpiece 54 against the table top 20 in response to a force applied by an air cylinder 132.

The transfer clamp 128 is removable from the transfer arm 126 to accommodate workpieces 54 of different configuration. The function of the transfer means 18 is to slide the workpiece 54 from the work holder 14 to the sewing head 16. In FIGS. 1 and 6, the transfer clamp 128 is sized to be received in a recess 134 provided by the presser 104. When the workpiece 54 has been shaped on the die plate 40 and is ready to be sewn, a command from the digital controller (not shown) causes the x-y positioner 124 to move the transfer clamp 128 horizontally to a position immediately above the recess 134 in the die plate 40. The cylinder 132 lowers the transfer clamp 128 through the recess 134 into engagement with the workpiece 54 and pushes the workpiece 54 gently against the table top 20.

The presser 104 is raised by the cylinder 110 out of engagement with the workpiece 54. The clamp 80 is retracted horizontally by the cylinder 88. The die plate 40 is retracted in the direction of the arrow 136 (FIG. 2) so the die plate 40 moves out of the central pocket 68. The x-y positioner 124 then moves the transfer arm 126 so the workpiece 54 slides along the work area 86 in a path toward the sewing needle 138 of the sewing head 16. When sewing starts, the x-y positioner 124 slides the workpiece 54 in a desired path so the stitch pattern creates the top stitching desired on the workpiece 54.

It will accordingly be seen that the work holder 14 avoids the use of an inverting and pressing operation separate from the top stitching operation and accordingly provides substantial economies without loss of throughput.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A semi-automatic sewing station of the type comprising a table having a generally planar section, a work holder for receiving and manipulating a fabric workpiece, means mounting the work holder above the table section for movement between a position juxtaposed to the table and a position spaced from the table, a sewing head having a reciprocable sewing needle defining a sewing location on the table, and means for sliding the fabric blank on the table section from the work holder to the sewing location including a transfer plate of a shape corresponding to the workpiece, means for moving the transfer plate in a path above the table top to a location over a die plate and then moving the transfer plate downwardly to captivate the workpiece against the table top, means for retracting the die plate from the workpiece, and means for moving the transfer plate to the sewing head, the improvement wherein the work holder comprises a die plate expandable from a first retracted position to receive the fabric workpiece and an extended position to stretch the workpiece;

means mounting the die plate from a first position adjacent the table section and a second elevated position spaced from the table section;

a support having a first position adjacent the table section under the die plate and a second elevated position juxtaposed to the die plate for pushing the workpiece against the underside of the die plate.

2. The sewing station of claim 1 further comprising means for simultaneously lowering the die plate and the support from the second elevated positions toward the first positions and captivating the workpiece during movement between the second positions and the first positions.

3. The sewing station of claim 2 wherein the die plate comprises a leading edge of a shape corresponding to the workpiece and further comprising means for moving the support, at the second elevated position, in a direction away from the leading edge parallel to the die plate.

4. The sewing station of claim 3 wherein the die plate provides a pair of side edges generally transverse to the leading edge and the support extends generally parallel to the leading edge and terminates short of the die plate side edges.

5. A semi-automatic sewing station of the type comprising a table having a generally planar section, a work holder for receiving and manipulating a fabric workpiece, means mounting the work holder above the table section for movement between a position juxtaposed to the table and a position spaced from the table, a sewing head having a reciprocable sewing needle defining a sewing location on the table, and means for sliding the fabric blank on the table section from the work holder to the sewing location, the improvement wherein the work holder comprises a die plate expandable from a first retracted position to receive the fabric workpiece and an extended position to stretch the workpiece, comprising a leading edge of a shape corresponding to the workpiece;

means mounting the die plate from a first position adjacent the table section and a second elevated position spaced from the table section;

a support having a first position adjacent the table section under the die plate and a second elevated position juxtaposed to the die plate for pushing the workpiece against the underside of the die plate;

an edge former comprising a plate juxtaposed to the table section and having a shape to closely receive the leading edge of the die plate and a lower edge for pushing the workpiece under the edge of the die plate, and means for moving the edge former in a horizontal direction from a first position spaced from the die plate to a second position juxtaposed to the die plate for pushing the workpiece under the edge of the die plate.

6. The sewing station of claim 5 further comprising means for heating the edge former.

7. The sewing station of claim 5 further comprising a press comprising a plate having a downwardly facing edge in the shape of the leading edge of the die plate and being mounted for movement between a first elevated position over the die plate and spaced therefrom and a second position over the die plate and juxtaposed thereto.

8. A semi-automatic sewing station of the type comprising a table having a generally planar section, a work holder for receiving and manipulating a fabric workpiece, means mounting the work holder above the table section for movement between a position juxtaposed to the table and a position spaced from the table, a sewing head having a reciprocable sewing needle defining a sewing location on the table, and means for sliding the fabric blank on the table section from the work holder to the sewing location, the improvement wherein the work holder comprises a die plate expandable from a first retracted position to receive the fabric workpiece and an extended position to stretch the workpiece, comprising a leading edge of a shape corresponding to the workpiece means mounting the die plate from a first position adjacent the table section and a second elevated position spaced from the table section;

a support having a first position adjacent the table section under the die plate and a second elevated position juxtaposed to the die plate for pushing the workpiece against the underside of the die plate;

a press comprising a plate having a downwardly facing edge in the shape of the leading edge of the die plate and being mounted for movement between a first elevated position over the die plate and spaced therefrom and a second position over the die plate and juxtaposed thereto.

9. The sewing station of claim 8 wherein the press is carried on the edge former.

10. A sewing station of the type comprising a table having a generally planar section, a work holder for receiving and manipulating a fabric workpiece, means mounting the work holder above the table section for movement between a position juxtaposed to the table and a position spaced from the table, a sewing head having a reciprocable sewing needle defining a sewing location on the table, and means for sliding the fabric blank on the table section from the work holder to the sewing location, the improvement wherein the work holder comprises a die plate expandable from a first retracted position to receive the fabric workpiece and an extended position to stretch the workpiece and having a leading edge in the shape of the workpiece;

means mounting the die plate from a first position abutting the table section and a second raised position spaced from the table section;

an edge former comprising a plate juxtaposed to the table section and having a shape to closely receive the leading edge of the die plate and a lower edge for pushing the workpiece under the edge of the die plate; and means for moving the edge former in a horizontal direction from a first position spaced from the die plate to a second position juxtaposed to the die plate for pushing the workpiece under the edge of the die plate.

11. The sewing station of claim 10 further comprising means for heating the edge former.

12. The sewing station of claim 11 wherein the heating means comprises a electric heater and a thermostat for controlling current to the electric heater.

13. The sewing station of claim 10 further comprising means for sliding the workpiece on the table top from the work holder to the sewing head, comprising a transfer plate of a shape corresponding to the workpiece, means for moving the transfer plate in a path above the table top to a location over the die plate and then moving the transfer plate downwardly to captivate the workpiece against the table top, means for retracting the die plate and the edge former from the workpiece, and means for moving the transfer plate to the sewing head.

14. The sewing station of claim 10 further comprising a press comprising a plate having a downwardly facing edge in the shape of the leading edge of the die plate and being mounted for movement between a first elevated position over the die plate and spaced therefrom and a second position over the die plate and juxtaposed thereto.

15. A sewing station of the type comprising a table having a generally planar section, a work holder for receiving and manipulating a fabric workpiece, means mounting the work holder above the table section for movement between a position juxtaposed to the table and a position spaced from the table, a sewing head having a reciprocable sewing needle defining a sewing location on the table, and means for sliding the fabric blank on the table section from the work holder to the sewing location, the improvement wherein the work holder comprises a die plate expandable from a first retracted position to receive the fabric workpiece and an extended position to stretch the workpiece and having a leading edge in the shape of the workpiece;

means mounting the die plate from a first position abutting the table section and a second raised position spaced from the table section;

a press comprising a plate having a downwardly facing edge in the shape of the leading edge of the die plate and being mounted for movement between a first elevated position over the die plate and spaced therefrom and a second position over the die plate and juxtaposed thereto.

16. The sewing station of claim 14 further comprising means for heating the press.

17. The sewing station of claim 16 wherein the heating means comprises a electric heater and a thermostat for controlling current to the electric heater.

18. The sewing station of claim 15 further comprising an edge former comprising a plate juxtaposed to the table section having a shape to closely receive the leading edge of the die plate and means moving the edge former in a horizontal direction from a first position spaced from the die plate and a second position juxtaposed to the die plate, the press being carried on the edge former.

19. The sewing station of claim 15 wherein the press is carried on the edge former.

20. A semi-automatic sewing station of the type comprising a table having a generally planar section, a work holder for receiving and manipulating a fabric workpiece having a central seam, means mounting the work holder above the table section for movement between a position juxtaposed to the table and a position spaced from the table, a sewing head having a reciprocable sewing needle defining a sewing location on the table, and means for sliding the fabric blank on the table section from the work holder to the sewing location, the improvement wherein the work holder comprises a die plate expandable from a first retracted position to receive the fabric workplace and an extended position to stretch the workplace, the die plate having a leading edge for juxtaposing the central seam of the workplace and an underside facing the table planar section;

means mounting the die plate from a first position adjacent the table section and a second elevated position spaced from the table section; and means for engaging the workplace on the underside of the die plate and means for moving the engaging means away from the leading edge of the die plate while pressing against the underside of the die plate for moving the seam of the workplace under the leading edge of the die plate.

* * * * *